US005896816A

United States Patent [19]

Dinger et al.

[11] Patent Number: 5,896,816

[45] Date of Patent: Apr. 27, 1999

[54] RERAILER APPARATUS

[75] Inventors: John M. Dinger, Brookville; Larry J. Saver, Falls Creek, both of Pa.

[73] Assignee: Brookville Mining Equipment Corporation, Brookville, Pa.

[21] Appl. No.: 09/031,628

[22] Filed: Feb. 27, 1998

Related U.S. Application Data

[62] Division of application No. 08/668,782, Jun. 24, 1996, Pat. No. 5,743,190.

[51] Int. Cl.[6] ..... B61K 5/02

[52] U.S. Cl. ..... 104/263; 104/273; 254/423

[58] Field of Search ..... 104/262, 263, 104/272, 273; 254/418, 423

[56] References Cited

U.S. PATENT DOCUMENTS

| | | | |
|---|---|---|---|
| 2,158,352 | 5/1939 | Brown | 104/263 |
| 2,684,641 | 7/1954 | Warf | 104/263 |
| 2,980,035 | 4/1961 | Cole et al. | 104/273 |
| 3,828,689 | 8/1974 | Raffenberg | 104/273 |
| 4,090,453 | 5/1978 | Ali et al. | 104/273 |
| 4,488,709 | 12/1984 | Chadwick | 254/423 |
| 4,606,273 | 8/1986 | Theurer et al. . | |
| 4,809,615 | 3/1989 | Brickett | 105/72.2 |
| 5,111,749 | 5/1992 | Theurer et al. | 104/2 |
| 5,203,264 | 4/1993 | Sodder, Jr. | 104/263 |
| 5,743,190 | 4/1998 | Dinger et al. | 104/263 |

*Primary Examiner*—S. Joseph Morano
*Attorney, Agent, or Firm*—Webb Ziesenheim Bruening Logsdon Orkin & Hanson, P.C.

[57] ABSTRACT

Disclosed is a rerailer apparatus that can be installed in a rail car for rerailing the rail car if it derails. The rerailer includes two vertical lifting members which are suspended from the rail car and are connected to a foot. These lifting members are used to lift the rail car vertically when the lifting members are extended and the foot contacts a support surface. A lateral movement member integrated with the vertical lifting members and the foot is used to move the lifted rail car laterally.

17 Claims, 19 Drawing Sheets

RERAILER APPARATUS

CROSS REFERENCE TO RELATED APPLICATION

This is a divisional of U.S. patent application Ser. No. 08/668,782, filed on Jun. 24, 1996, now U.S. Pat. No. 5,743,190.

BACKGROUND OF THE INVENTION

1. Field of the Invention

The present invention relates to a rerailer apparatus and, more particularly, to a rerailer that can be contained within mining rail cars.

2. Background Art

The accidental derailing of rail cars, including locomotives, is not uncommon, especially in the underground mining industry. When a rail car derails, some type of lifting device is required to lift and move the car over the rails for rerailing. Two general types of lifting devices are known in the prior art. The first type is independent of the rail car and must be positioned near the car in order to lift and move the derailed car. This type of rerailer is shown in U.S. Pat. Nos. 2,980,035; 3,828,689; 4,090,453; 4,825,771; and 5,203,264. The second type of rerailer is mounted to the rail car as shown in U.S. Pat. Nos. 2,684,641; 4,606,273; 4,809,615; and 5,111,749.

Both types of known lifting devices present problems to the underground mining industry since the available space to maneuver around a derailed car is usually quite limited. Because of the space constraints in an underground mine, the mining industry has avoided both the known types of lifting devices due to their size, complexity or need for additional support in order to operate. Today, the underground mining industry continues the dangerous practice of lifting a derailed rail car with a hand jack, one end of the car at a time, pushing the car toward the rails until the jack flies out from under the car, and then repeating these steps as many times as needed until the car is once again positioned on the rails. This practice is dangerous to mine workers, is abusive to the equipment and can take up to four hours to rerail a car.

It is an object of the present invention to provide a compact and simple lifting apparatus which can be contained within a rail car to aid in rerailing a rail car, particularly a rail car used in underground mining, in a quick and safe manner.

SUMMARY OF THE INVENTION

We have invented a rerailer apparatus that can be installed in a rail car for rerailing the rail car if it derails. The rerailer includes two vertical lifting members which are suspended from the rail car and are connected to a foot. These lifting members are used to lift the rail car vertically when the lifting members are extended and the foot contacts a support surface. A lateral movement member integrated with the vertical lifting members and the foot is used to move the lifted rail car laterally. Through a sequential operation of the vertical lifting members and lateral movement members, a rail vehicle can be "walked" back over to its proper position on the rails.

In one embodiment of our invention, a sliding platform can be provided as the lateral movement member. The sliding platform is connected to the vertical lifting members and slidably fixed to the foot to allow lateral movement between the sliding platform and the foot. Bearing assemblies are used to provide uniform movement between the sliding platform and the foot. A lateral movement device is used to provide the lateral movement between the sliding platform and the foot. The vertical lifting members and the lateral movement device are ideally provided as hydraulic cylinders.

In another embodiment of our invention, the vertical lifting members can be each enclosed in a leg that is extended and retracted with the vertical lifting members. Each leg is pivotally connected to the rail car at one end and pivotally connected to the foot at the other end. Two angled lifting members act as the lateral movement member. The two angled lifting members are each connected at one end to the rail car at a location between the vertical lifting members and diverge away from each other and toward one of the legs. The other end of each angled lifting member is connected to an adjacent leg near the pivot point of the leg and the foot. The vertical lifting members and angled lifting members are ideally provided as hydraulic cylinders.

DESCRIPTION OF THE PREFERRED EMBODIMENTS

The present invention provides a rerailer to be contained in a rail car for rerailing the car if it derails. As will be explained hereinafter in more detail, the rerailer is an apparatus which is simple to operate, reduces the time required to rerail a car and provides an operation which is safer for operators and equipment. The rerailer is particularly suited for rail cars used in underground mines.

Figure 1:
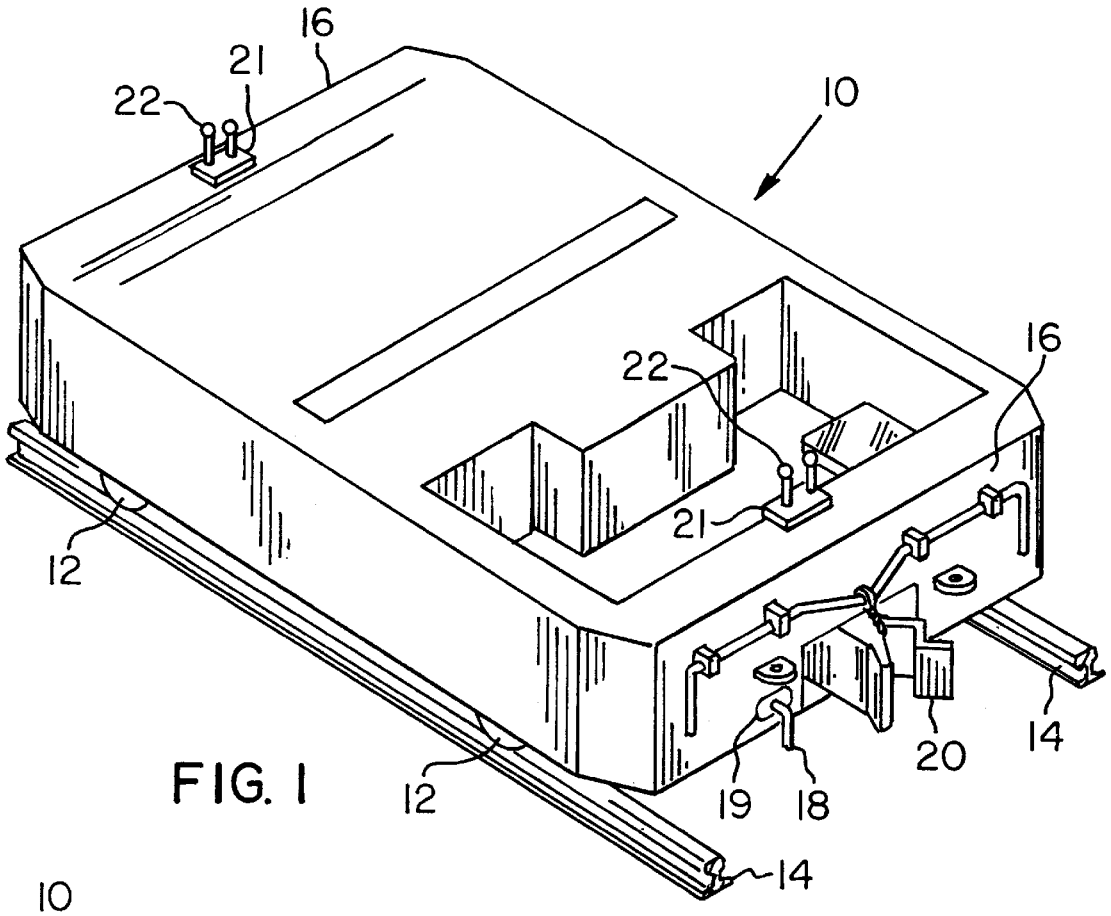
FIG. 1 is a perspective view of a rail car including a rerailer of the present invention.

FIG. 1 illustrates a rail car used in the mining industry. The rail car of FIG. 1 is a locomotive 10 having wheels 12 which ride on spaced rails 14. The locomotive 10 has a bumper 16 on each of its front and rear ends. A coupler 20 is shown extending from one of the bumpers 16. The coupler 20 can also be mounted internal to the bumper 16. A rerailer in accordance with the present invention (not visible in FIG. 1 but shown hereinafter) is contained in each bumper 16. A valve control assembly 21 having levers 22 is mounted on each end of the locomotive 10 to operate the rerailer in an associated bumper 16. The valve control assembly 21 is mounted to allow operator visibility during movement of the locomotive 10 so that only one person is needed to operate a rerailer. A locking device 18 is provided in each bumper 16 to lock the rerailer within the bumper 16. A hole 19 is provided in each bumper 16 so that the locking device 18 may be installed. The locking device 18 must be deliberately removed before the rerailer can function. In this manner, the locking device 18 prevents an operator from inadvertently activating the rerailer.

FIGS. 2–6 show the basic structure and operation of a rerailer in accordance with the present invention. Two specific embodiments of the rerailer will be described in further detail hereinafter, but their basic structure and operation are similar. The operation of moving a rail car using the rerailer as shown in FIGS. 2–6 is referred to as "walking" the rail car.

Figure 2:
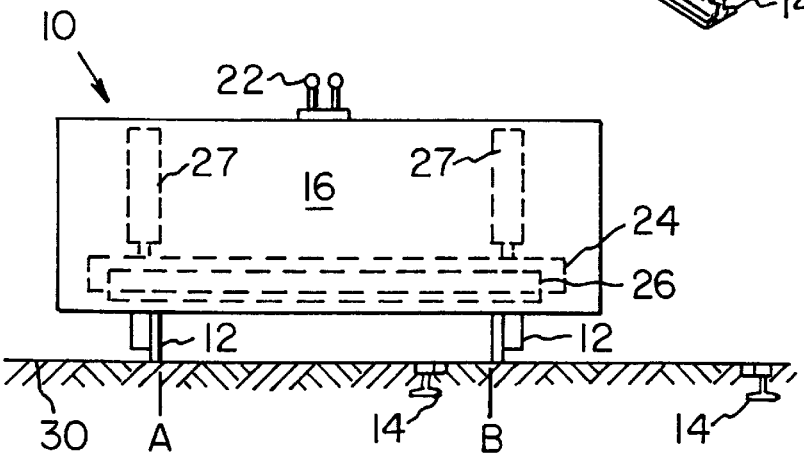
FIG. 2 is a front view of a rail car including a rerailer according to the present invention with a foot in the fully retracted position.
Figure 3:
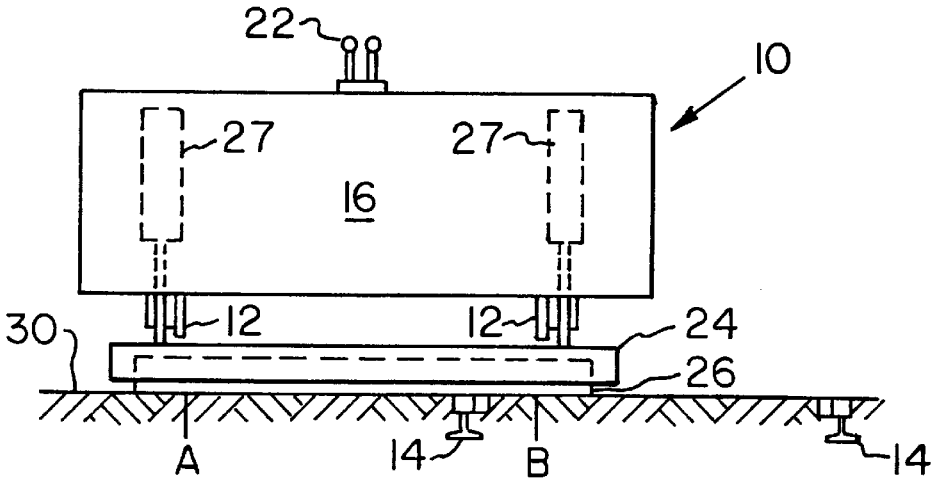
FIG. 3 is a front view of the rail car shown in FIG. 2 with the foot of the rerailer in the extended position.

FIG. 2 shows the locomotive 10 derailed from rails 14. Reference points A and B in FIGS. 2–6 indicate the original position of the inside surface of wheels 12 of the locomotive 10 before starting the process of walking the locomotive 10. The rerailer includes a foot 26 connected to a pair of vertical lifting members 27 for lifting and lowering the locomotive 10 as shown in FIGS. 2–6. The foot 26 is lowered by extending the vertical lifting members 27 which are suspended inside the bumper 16 of the locomotive 10. The lifting members 27 can be a hydraulic cylinder or other type of jacking device. The foot 26 is lowered until it contacts a support surface 30, such as the ground or rails as shown in FIG. 3. After the foot 26 contacts the support surface 30, the vertical lifting members 27 are extended further until the wheels 12 of the locomotive 10 closest to the rerailer are lifted from the support surface 30. Each vertical lifting member 27 should have the capacity to lift at least one-quarter (¼) the weight of the locomotive 10.

Figure 4:
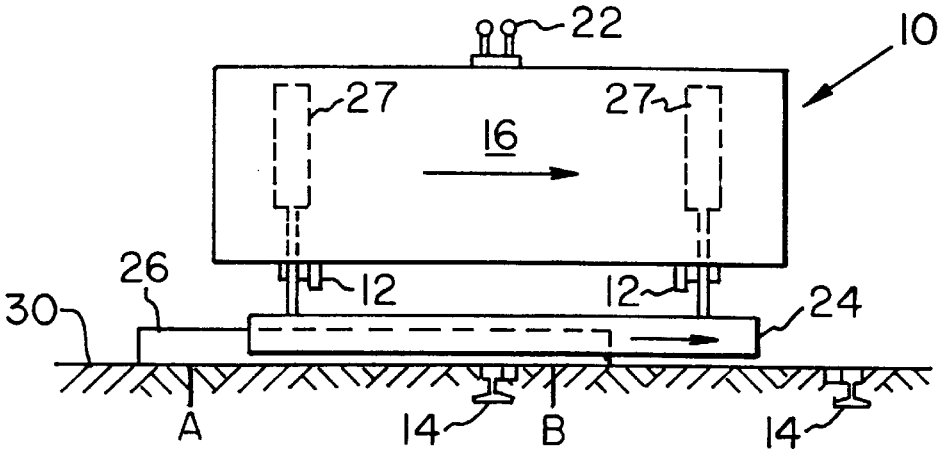
Fig. 4 is a front view of the rail car shown in FIG. 2 during lateral movement of the rail car.
Figure 5:
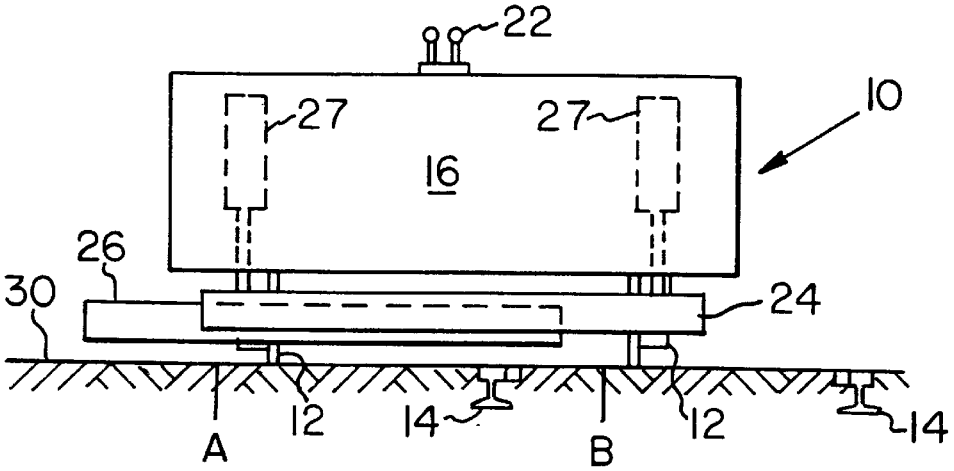
FIG. 5 is a front view of the rail car shown in FIG. 2 during partial retraction of the foot.

Once the locomotive 10 has been lifted, a lateral movement member 24 employing a lateral movement device, such as a hydraulic cylinder (not shown), is used to move the locomotive 10 laterally while the foot 26 maintains its position on the support surface 30 as shown in FIG. 4. The vertical lifting members 27 are then retracted as shown in FIG. 5 to first lower the wheels 12 of the locomotive 10 back to the support surface 30 and then to raise the foot 26 back above the support surface 30. The lateral movement device of the lateral movement member 24 is then actuated to laterally move the foot 26 back to its original or normal position under the locomotive 10 as shown in FIG. 6.

Figure 6:
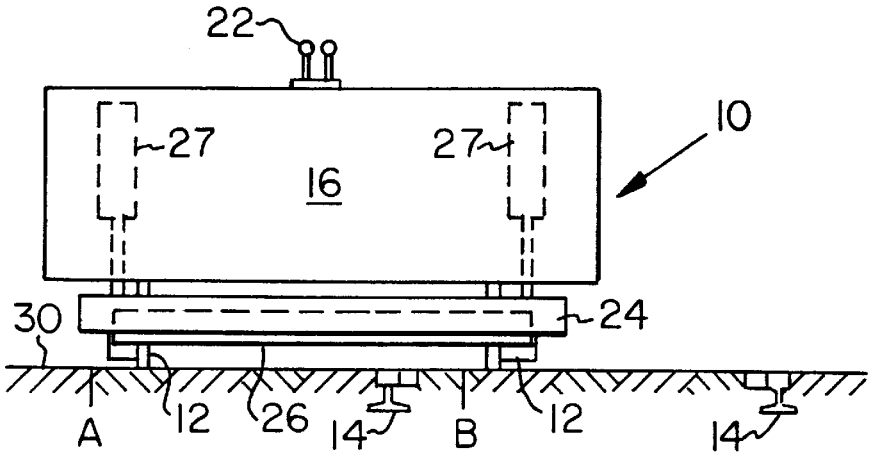
FIG. 6 is a front view of the rail car shown in FIG. 2 during realignment of the foot.

The operation shown in FIGS. 3–6 is repeated as often as necessary until the wheels 12 of the locomotive 10 engage the rails 14 when the locomotive 10 is lowered. Once the locomotive 10 is rerailed, the foot 26 is positioned laterally as shown in FIG. 6 and then fully retracted into the bumper 16 of the locomotive 10 as shown in FIG. 2.

FIGS. 7–12 show one specific embodiment of a rerailer 60 before it is attached inside of the locomotive 10. Rerailer 60 is suspended within the bumper 16 by a pair of body yokes 62 on each of a pair of spaced vertical hydraulic cylinders 63. The body yokes 62 are connected to the frame of the locomotive 10 when the rerailer 60 is suspended within the locomotive's bumper 16. Rod yokes 64 on the vertical hydraulic cylinders 63 are connected to tongues 66 of a sliding platform 68.

The foot 69 is made of a flat section 67, a flange 73 which extends upward from the flat section 67 and a tongue 77. The flange 73 includes a middle section 71 which extends upward beyond surfaces 94 of the flange 73. The tongue 77 is connected to one end of the middle section 71.

The sliding platform 68 is formed of two individual plates 70 defining space 72 therebetween. The space 72 is wide enough to allow the flange 73 to fit and slide between the plates 70. A horizontal hydraulic cylinder 74 has a body yoke 76 connected to tongue 78 which is part of sliding platform 68. The horizontal hydraulic cylinder 74 has a rod yoke 80 connected to tongue 77 of the flange 73. The movement of the cylinder rod 84 of the horizontal hydraulic cylinder 74 to the left or right moves the foot 69 left or right, respectively.

Figure 10:
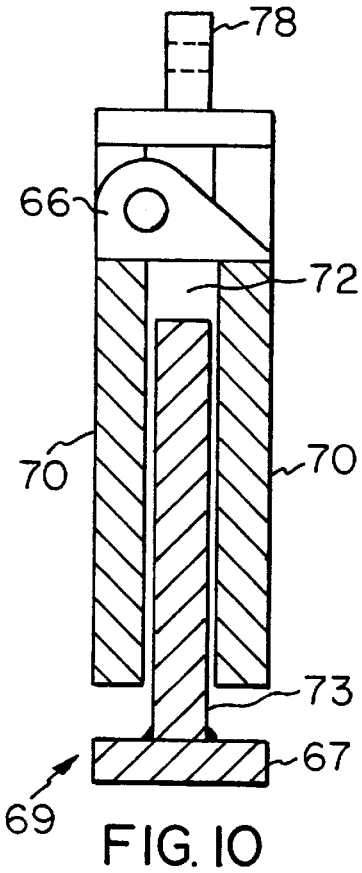
FIG. 10 is a section taken along line X—X in FIG. 7.
Figure 9:
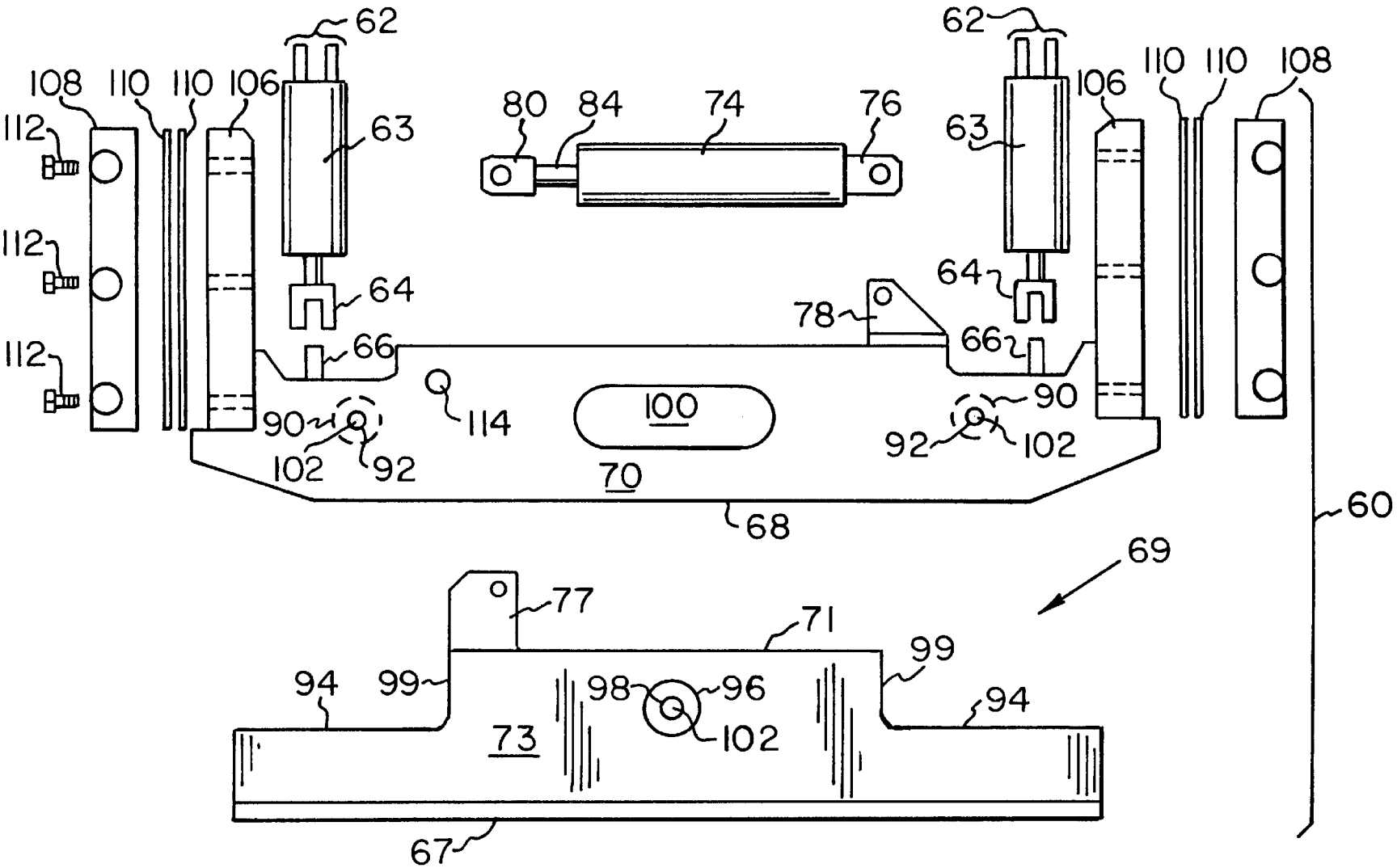
FIG. 9 is an exploded front view of the rerailer shown in FIG. 7.

Self-aligning bearing assemblies 86 and 88 allow the foot 69 and the sliding platform 68 to move uniformly and smoothly in relation to each other. A cross-sectional view of bearing assemblies 86 and 88 is shown in FIGS. 9 and 10, respectively. Two bearing assemblies 86 are fixed to the sliding platform 68 and have a single bearing 90 rotatably fixed to a shaft 92. Bearings 90 rotate along the top surfaces 94 of the foot 69. Bearing assembly 88 is fixed to the flange 73 of the foot 69 and has a bearing 96 on each side of the foot 69 which is rotatably fixed to a shaft 98. Bearings 96 rotatably move within the slot 100 in each plate 70 of the sliding platform 68. Edges 99 on the middle section 71 of the foot 69 serve as stops to restrict movement of the foot 69 when bearings 90 make contact with these edges 99. Each shaft 92 and 98 includes a grease fitting 102 to lubricate the associated bearing assemblies.

Figure 11:
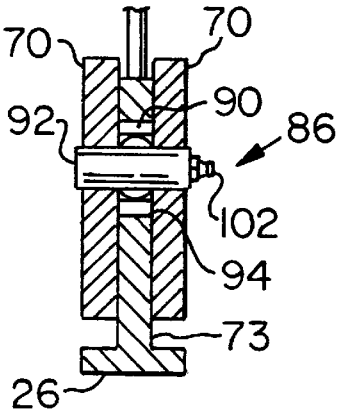
FIG. 11 is a section taken along line XI—XI in FIG. 7.
Figure 12:
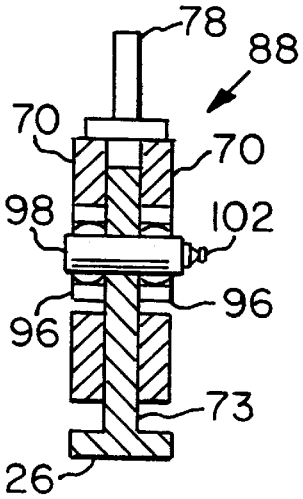
FIG. 12 is a section taken along line XII—XII in FIG. 7.
Figure 8:
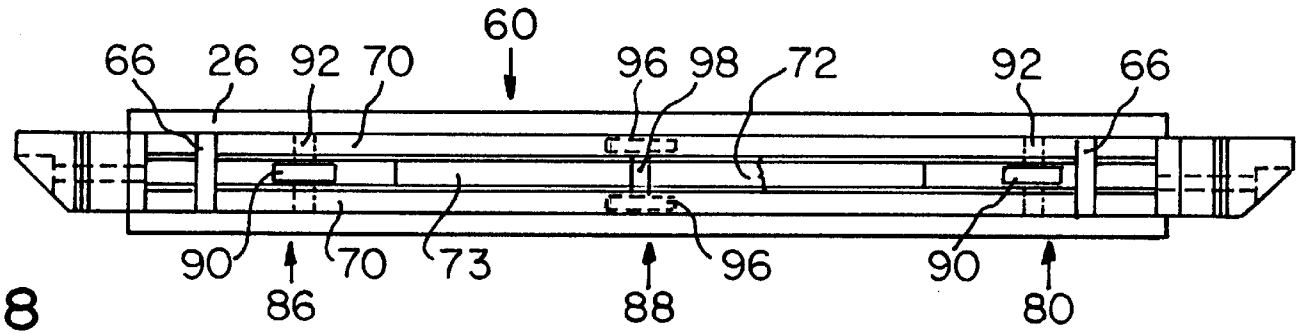
FIG. 8 is a top view of the rerailer shown in FIG. 7 with the hydraulic cylinders removed.
Figure 7:
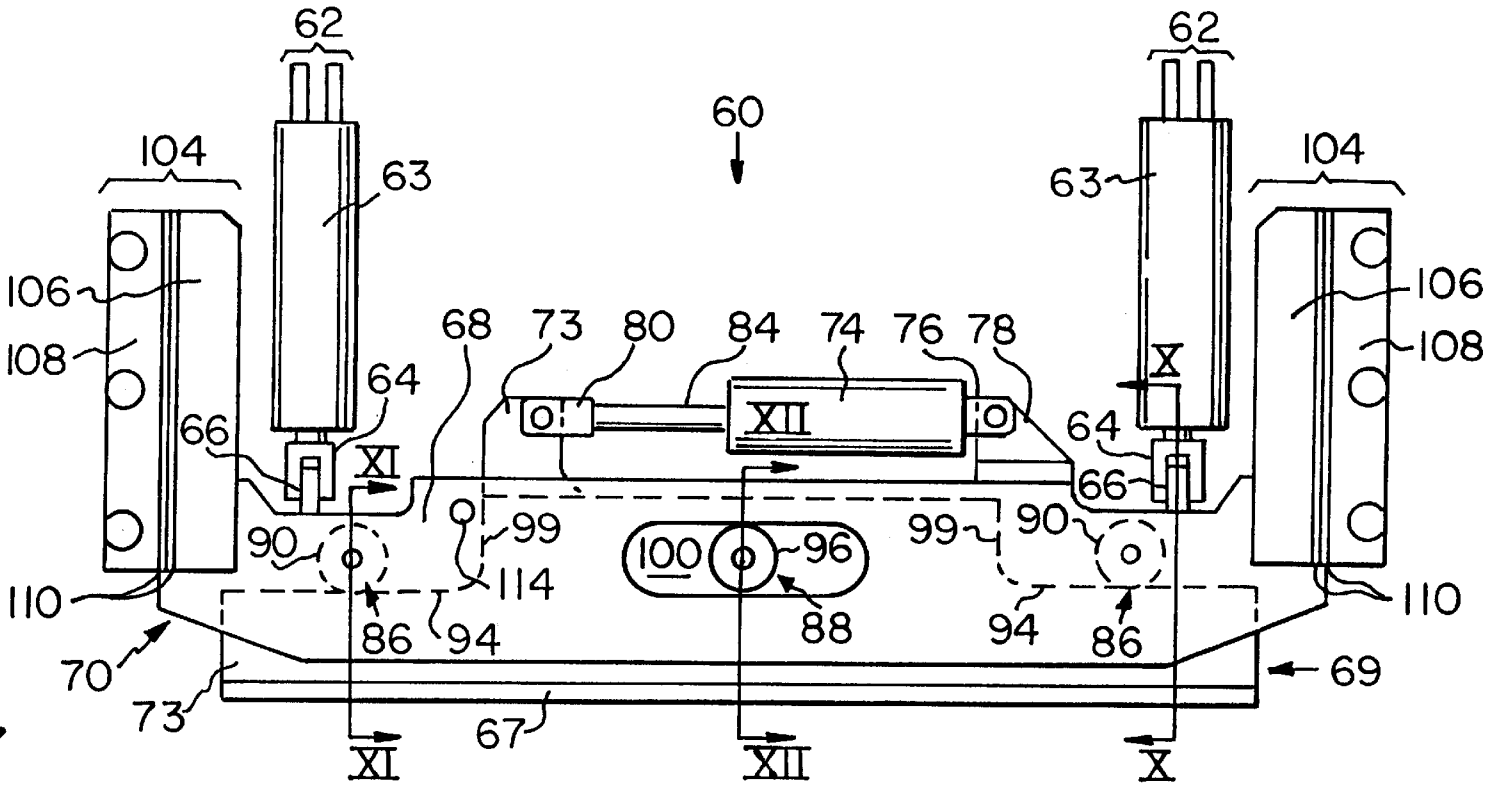
FIG. 7 is a front view of a first specific embodiment of a rerailer according to the present invention.

FIGS. 7–9 show a wear guide 104 on each side of the rerailer 60. The wear guides 104 run along the inside surface of the bumper 16 and maintain alignment of the rerailer 60 within the bumper 16 as the various elements of the rerailer 60 move up and down. FIG. 11 shows that the wear guide 104 is made up of a permanent section 106, a replaceable end 108 and spacing shims 110. The permanent section 106 is permanently attached to the plates 70 of the sliding platform 68. The replaceable end 108 is fixed to the permanent section 106 by bolts 112 and is shaped to conform to the inside shape of the bumper 16 of the locomotive 10. The spacing shims 110 are placed between the replaceable end 108 and the permanent section 106 to provide a proper fit within the bumper 16.

Figure 13:
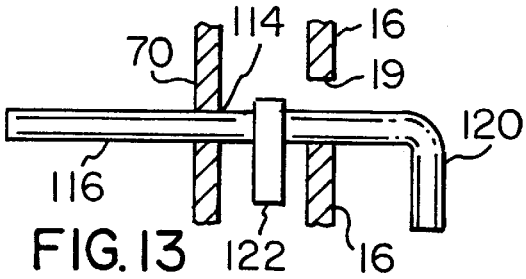
FIG. 13 is a side view of a locking pin used with the rerailer shown in FIG. 7.
Figure 14:
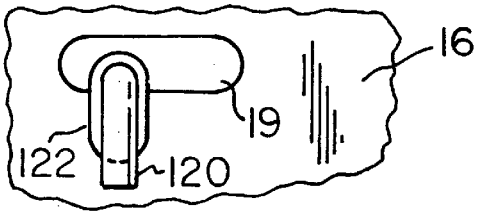
FIG. 14 is a front view of the locking pin shown in FIG. 13.

At least the front plate 70 of the sliding platform 68 includes a hole 114 for receiving a locking pin 116 shown in FIGS. 13–14. The locking pin 116 is one embodiment of the locking device 18 shown in FIG. 1. The locking pin 116 is L-shaped and has a head 120 and an oval shaped stop 122. Stop 122 is configured to fit in an oval hole 19 in the bumper 16. The locking pin 116 is rotated so that the stop 122 can be inserted through the hole 19. The pin 116 is inserted until it engages hole 114 of front plate 70. Then the pin 116 is rotated downward so that stop 122 restricts the removal of pin 116. Once installed, the locking pin 116 prevents the movement of the rerailer 60 within the bumper 16 until the pin 116 is removed by reversing the process of insertion.

Figure 15:
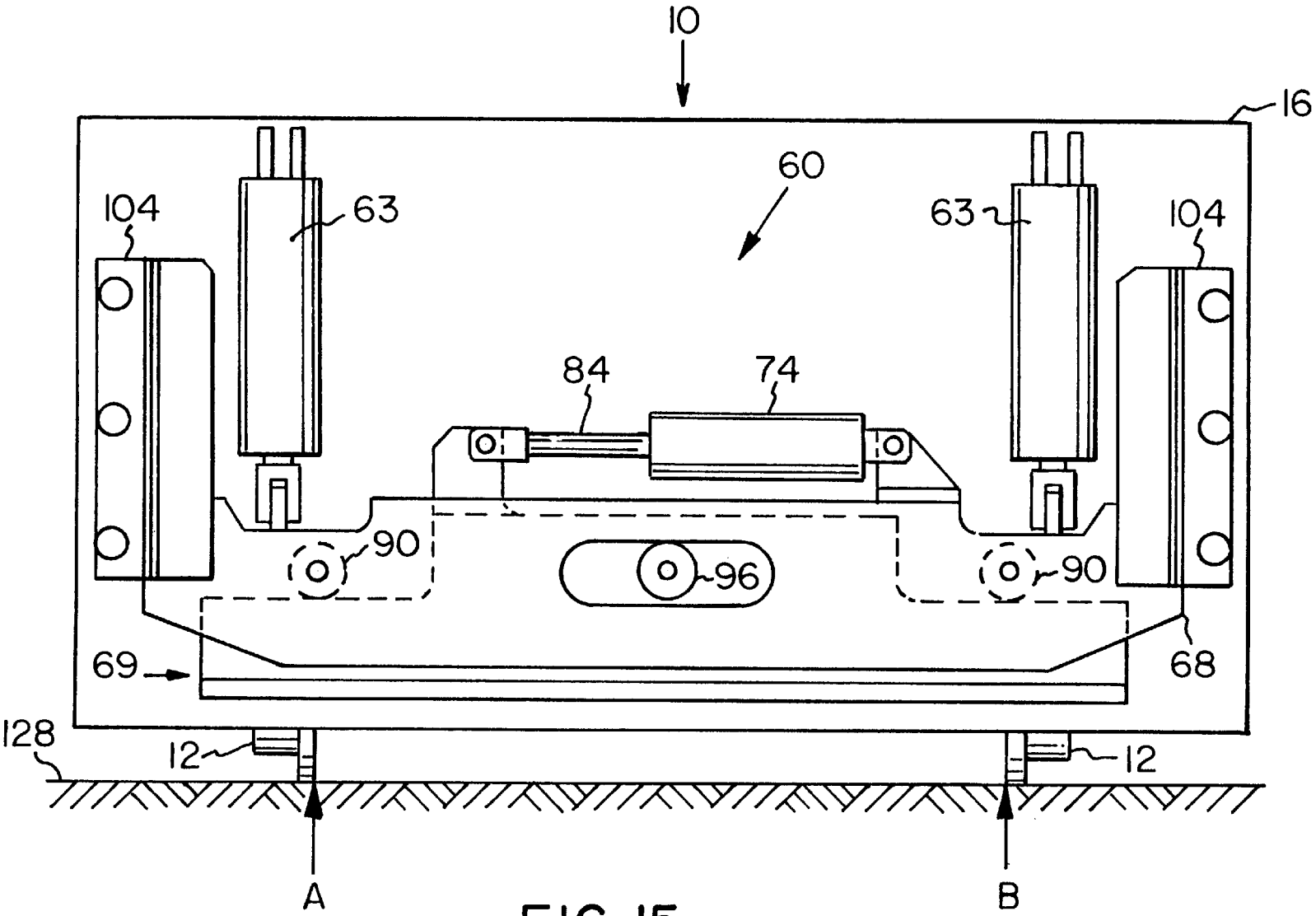
FIG. 15 is a front view of the rerailer shown in FIG. 7 suspended in a rail car and with the foot fully retracted.
Figure 16:
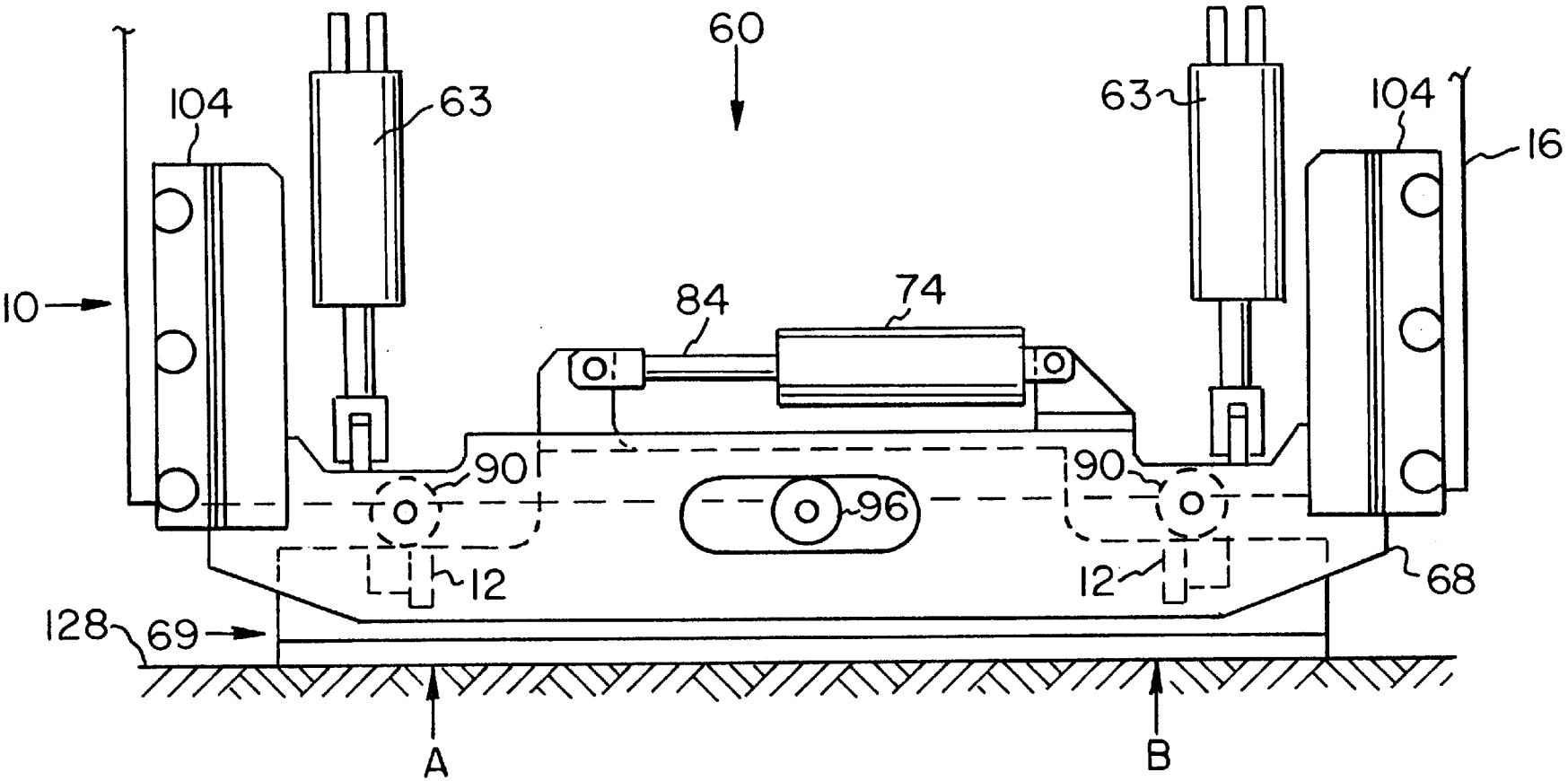
FIG. 16 is a front view of the rerailer shown in FIG. 7 with the foot extended from the rail car.

FIGS. 15–19 show the operation of the rerailer 60 within the bumper 16 of the locomotive 10. FIG. 15 shows the rerailer 60 raised within a derailed locomotive 10 which rests on the ground 128. Reference points A and B in FIGS. 15–19 indicate the original position of the inside surface of wheels 12 of the locomotive 10 during the walking of the locomotive 10. FIG. 16 shows the foot 69 of the rerailer 60 in contact with the ground 128 and the locomotive 10 and its wheels 12 raised above the ground 128 after the vertical hydraulic cylinders 63 have been extended or actuated downward.

Figure 17:
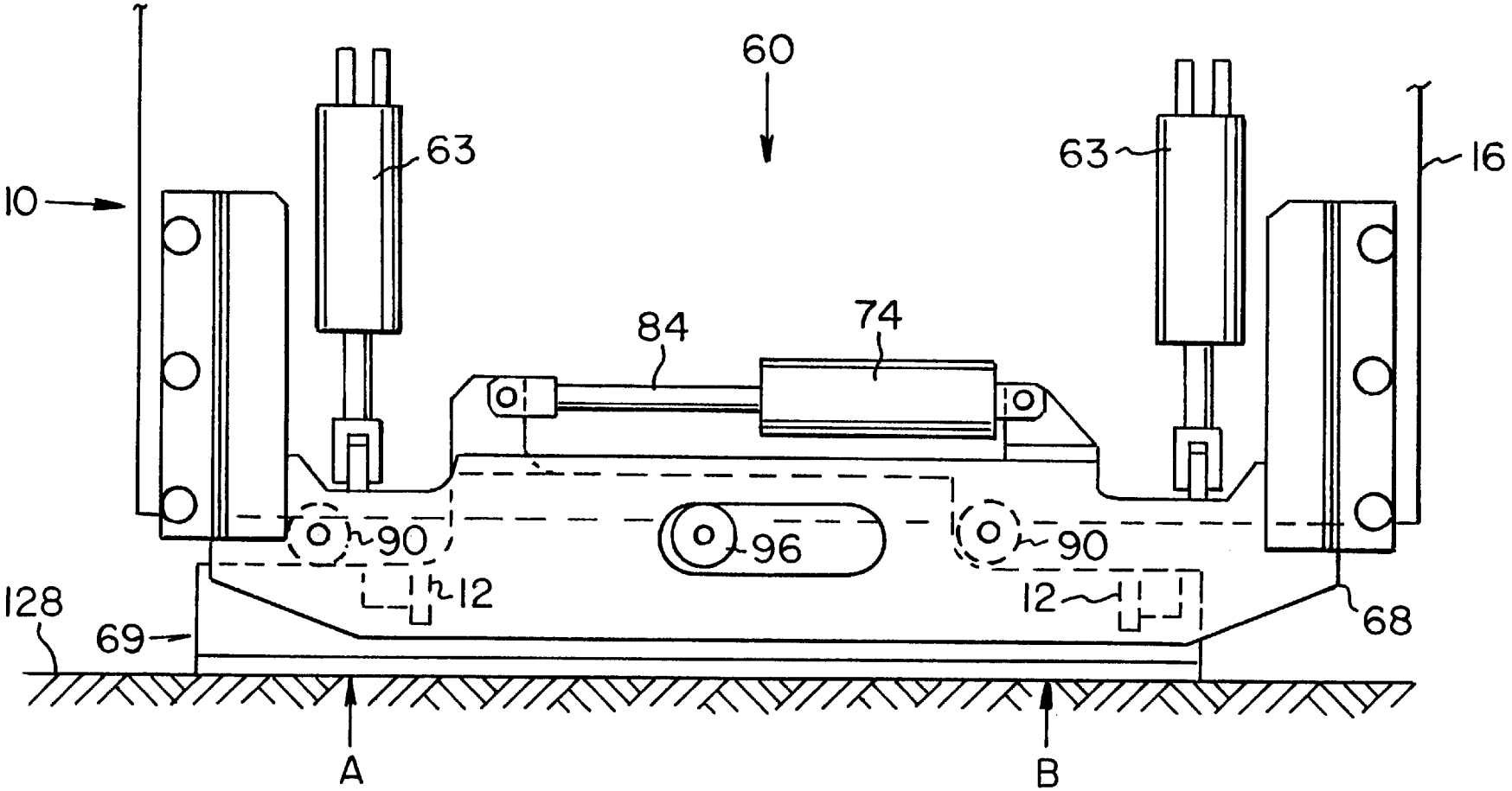
FIG. 17 is a front view of the rerailer shown in FIG. 7 during lateral movement of the rail car.
Figure 18:
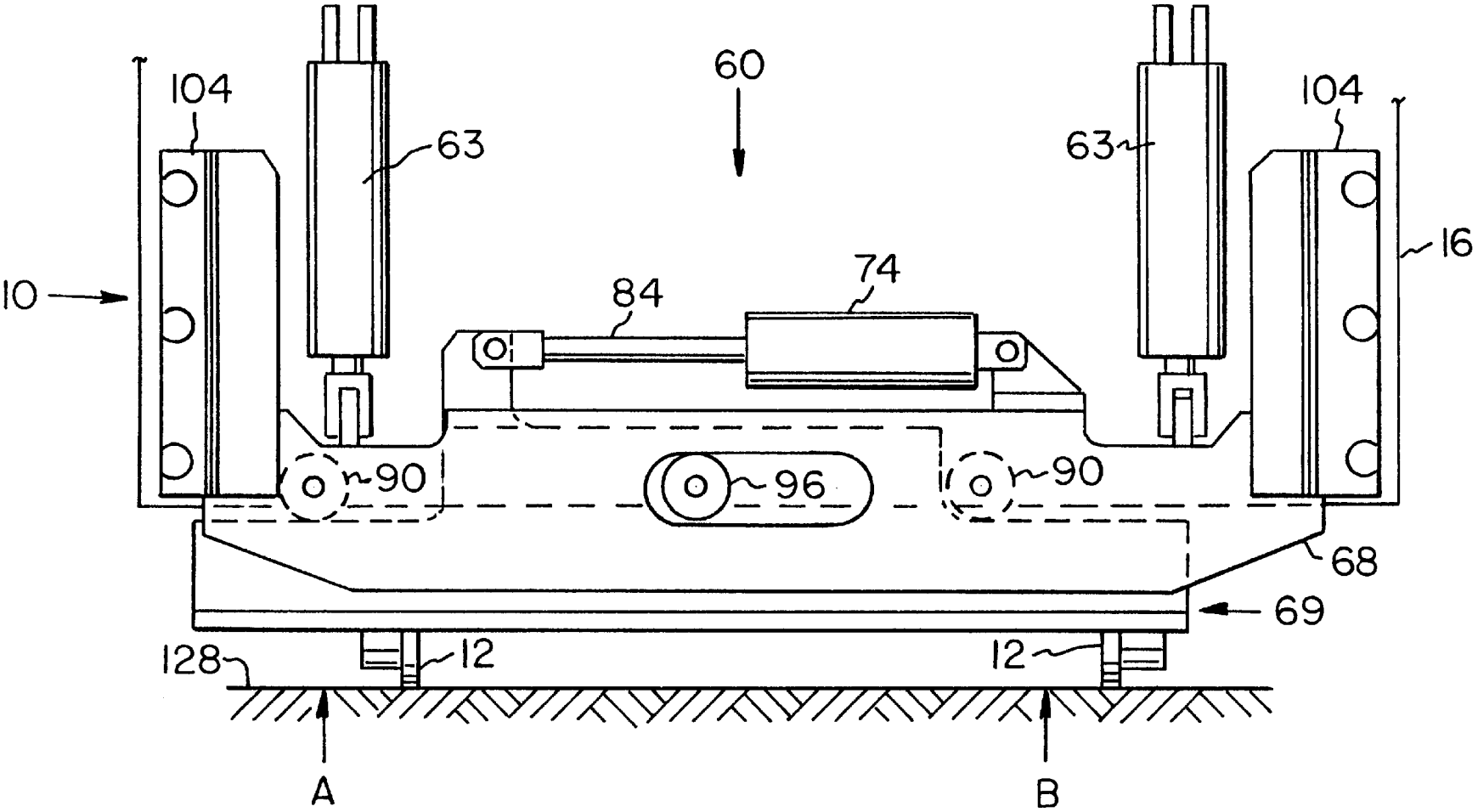
FIG. 18 is a front view of the rerailer shown in FIG. 7 with the foot partially retracted.
Figure 19:
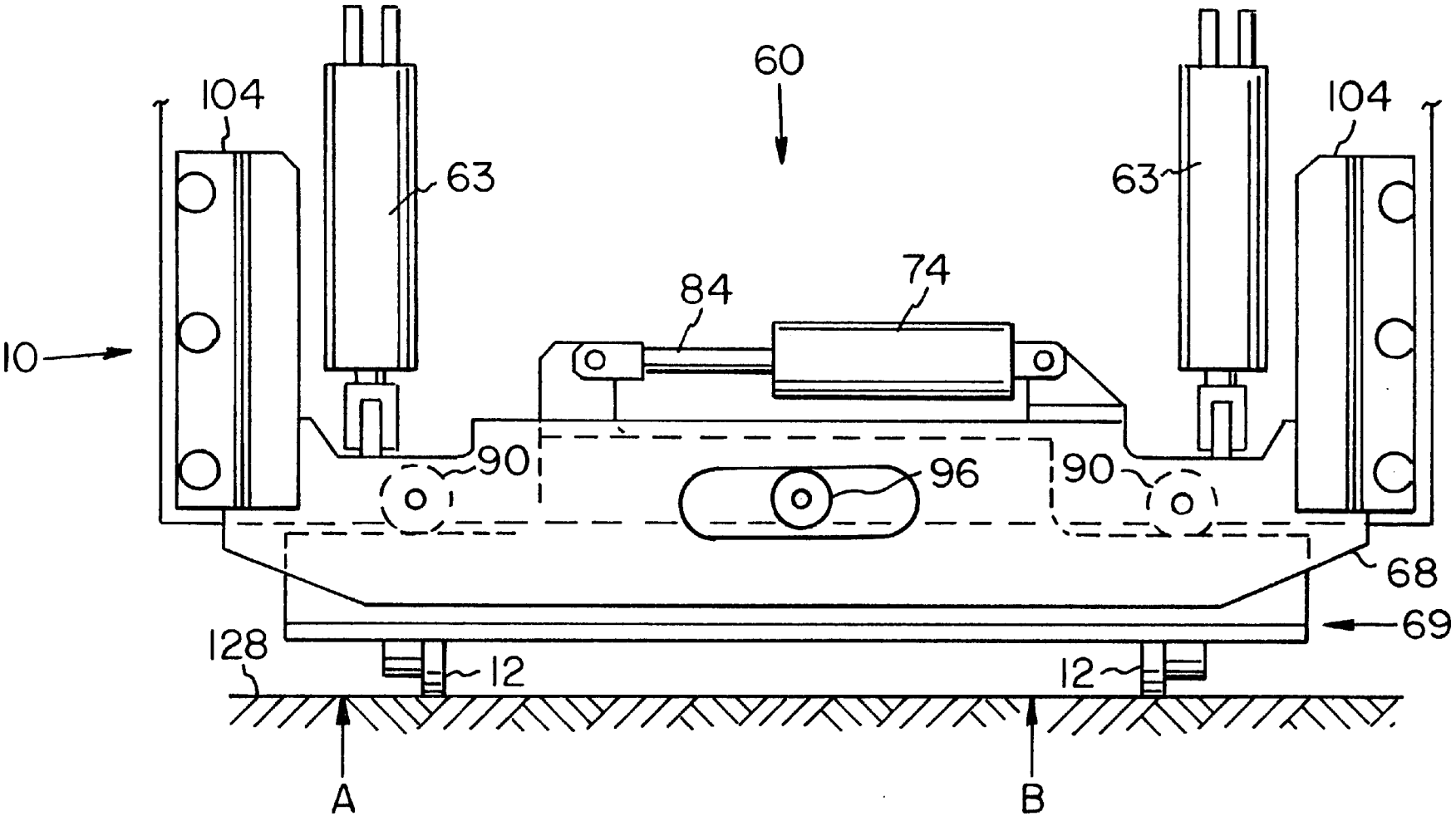
FIG. 19 is a front view of the rerailer shown in FIG. 7 during realignment of the foot.

FIG. 17 shows the locomotive 10 moving toward the right in relation to reference points A and B when the rod 84 of the horizontal hydraulic cylinder 74 is extended. Note the position of bearings 90 and 96 in FIGS. 16 and 17. The sliding platform 68 moves in this case instead of the foot 69 because the weight of the locomotive 10 securely fixes the foot 69 to the ground 128. The coefficient of friction is higher between the foot 69 and the ground 128 than between the bearings 90 and 96 and the surfaces the bearings 90 and 96 contact, which allows the sliding platform 68 to move to the right. The locomotive 10 also moves because it is connected to the sliding platform 68 via the vertical hydraulic cylinders 63 and because of the wear guides 104 which are partially retained in the bumper 16. FIG. 18 shows the foot 69 of the rerailer 60 raised above the ground 128 but not fully retracted into the locomotive 10 which has been lowered back to the ground 128. The rod 84 of horizontal hydraulic cylinder 74 is then retracted moving the foot 69 to the right and underneath the locomotive as shown in FIG. 19. The operation shown in FIGS. 16–19 can be repeated until the locomotive 10 is rerailed. Once the locomotive 10 is rerailed, the rerailer 60 can be fully retracted into the bumper 16 of the locomotive 10 as shown in FIG. 15.

Figure 20:
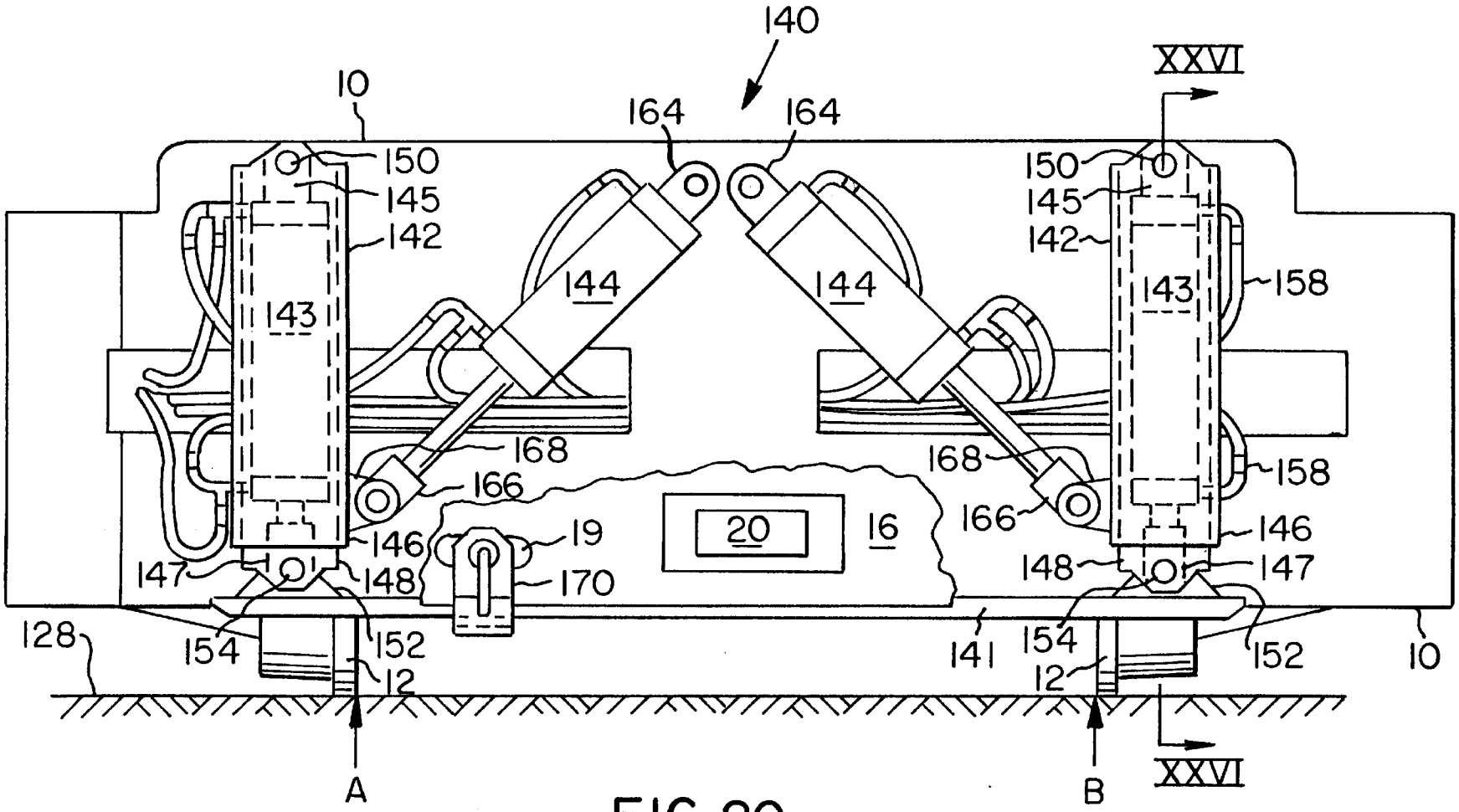
FIG. 20 is a front view of a second specific embodiment of a rerailer according to the present invention suspended in a rail car with the foot fully retracted.

FIGS. 20–29 show another embodiment of a rerailer in accordance with the present invention. This configuration of a rerailer can be used when the coupler 20 for the locomotive 10 is mounted inside of the bumper 16 and less space is available in the bumper for rerailer 60 described above. As shown in FIG. 20, rerailer 140 includes a foot 141, two legs 142, a pair of vertical hydraulic cylinders 143 and a pair of angled hydraulic cylinders 144. Each leg 142 includes an outer section 146 and an inner section 148, which are both square tubes in this embodiment. The inner section 148 slides in and out of the outer section 146 and the space between the sections is lubricated. The outer section 146 is connected to the frame of the locomotive 10 at a pivot point 150. A body yoke 145 of the vertical hydraulic cylinder 143 is also connected to the frame at the same pivot point 150. The main body of the vertical hydraulic cylinder 143 is cf a size that allows it to fit within the inner section 148 of the leg 142. The rod yoke 147 of the vertical hydraulic cylinder 143 is connected to the inner section 148 of the leg 142 at a tongue 152 which is part of the foot 141. Tongue 152 has a pivot point 154 that allows the rod yoke 147 and the leg 142 to pivot at the foot 141. Angled hydraulic cylinders 144 have a body yoke 164 fixed to the frame, and a rod yoke 166 fixed to tongue 168 which extends from the outer section 146 of leg 142. The angled arrangement of the angled hydraulic cylinders 144 provides space within the bumper for straddling a coupler 20 therein.

Figure 26:
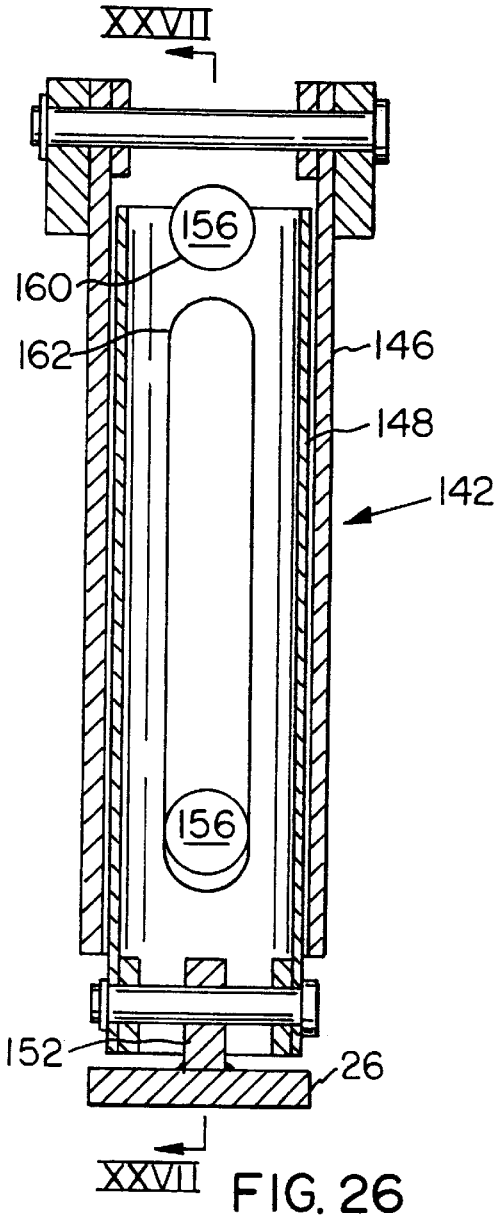
FIG. 26 is a section taken along line XXVI—XXVI in FIG. 20 with the hydraulic cylinder removed.
Figure 27:
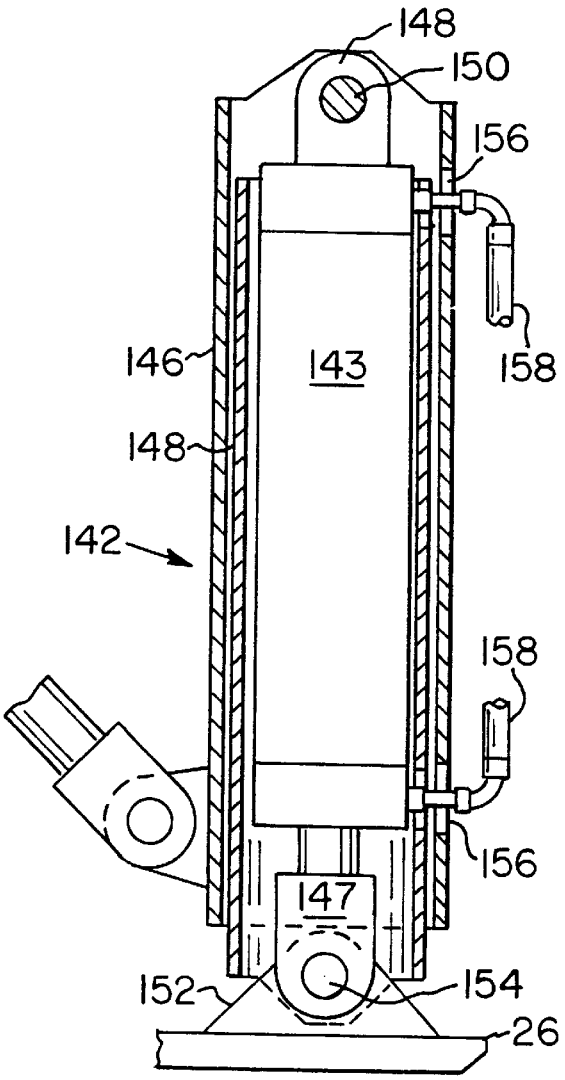
FIG. 27 is a section taken along line XXVII—XXVII in FIG. 26 with the hydraulic cylinder in place.

FIG. 26 shows a cross-sectional side view of an assembled leg 142 with the vertical hydraulic cylinder 143 removed. FIG. 27 shows a cross-sectional front view of an assembled leg 142. On one side of each outer section 146 of the leg 142 are two holes 156 to receive the hydraulic hoses 158 that operate the vertical hydraulic cylinder 143. Each inner section 148 of the leg 142 has a half slot 160 at its upper end and a full slot 162 along its middle to allow the inner section 148 to move within the outer section 146 without interfering with the hoses 158.

Figure 28:
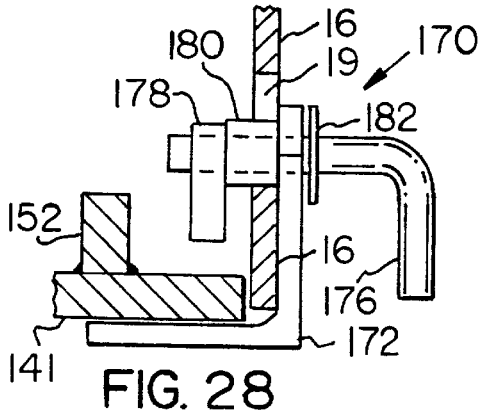
FIG. 28 is a side view of a locking member used with the rerailer shown in FIG. 20.
Figure 29:
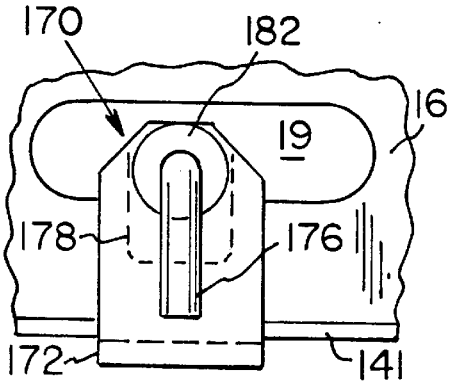
FIG. 29 is a front view of the locking member shown in FIG. 28.

The locking device 18 used with rerailer 140, as shown in FIGS. 28 and 29, is a locking member 170. Locking member 170 is used to restrict downward movement of the foot by clamping it upward. The locking member 170 includes a locking clamp 172, an L-shaped pin 176, an ovalshaped stop 178, a spacer 180, and a washer 182. The stop 178 is fixed to pin 176 and the pin 176 is rotatably attached to the locking clamp 172. The spacer 180 is usually thicker than the bumper wall 184. The pin 176, along with the stop 178, is rotated to fit in the oval hole 19 of bumper 16 when the rerailer 140 is fully retracted inside the bumper 16. As the pin 176 and stop 178 are inserted, the locking clamp 172 is positioned as shown underneath the foot 141. Once inserted, the pin 176, along with the stop 178, is rotated downward which restricts removal of the locking member 170.

Figure 21:
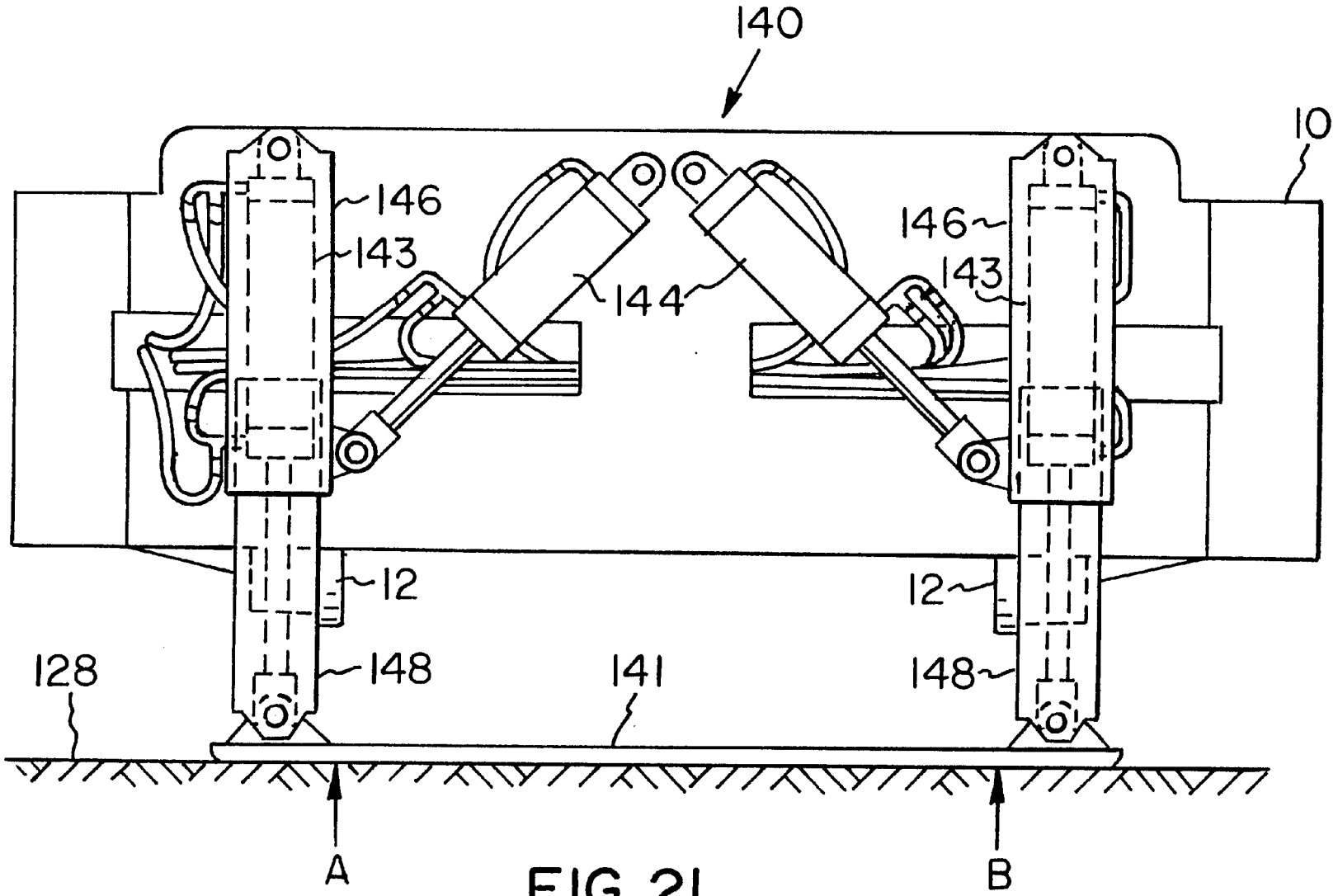
FIG. 21 is a front view of the rerailer shown in FIG. 20 with the foot extended.
Figure 22:
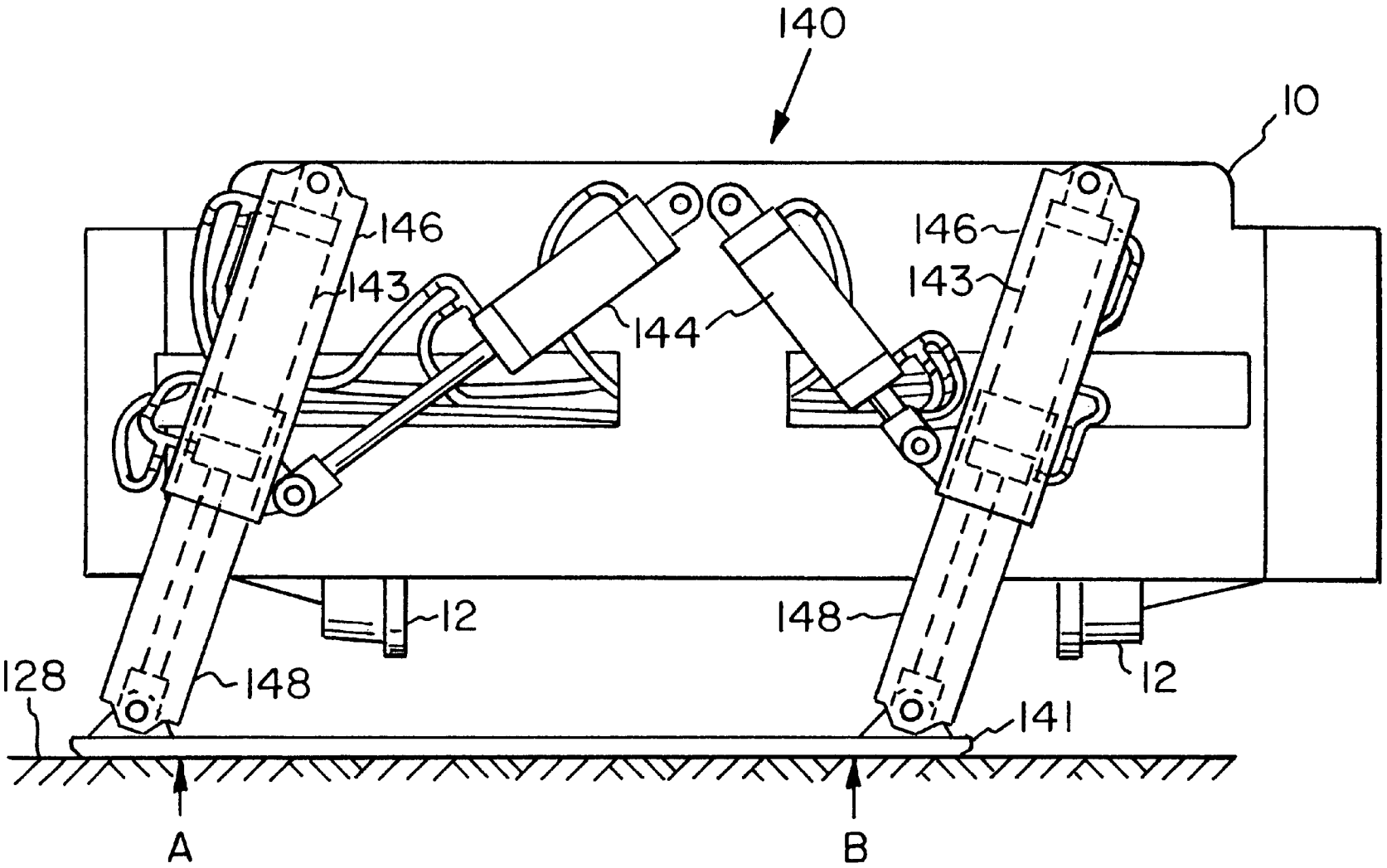
FIG. 22 is a front view of the rerailer shown in FIG. 20 during lateral movement of the rail car.
Figure 23:
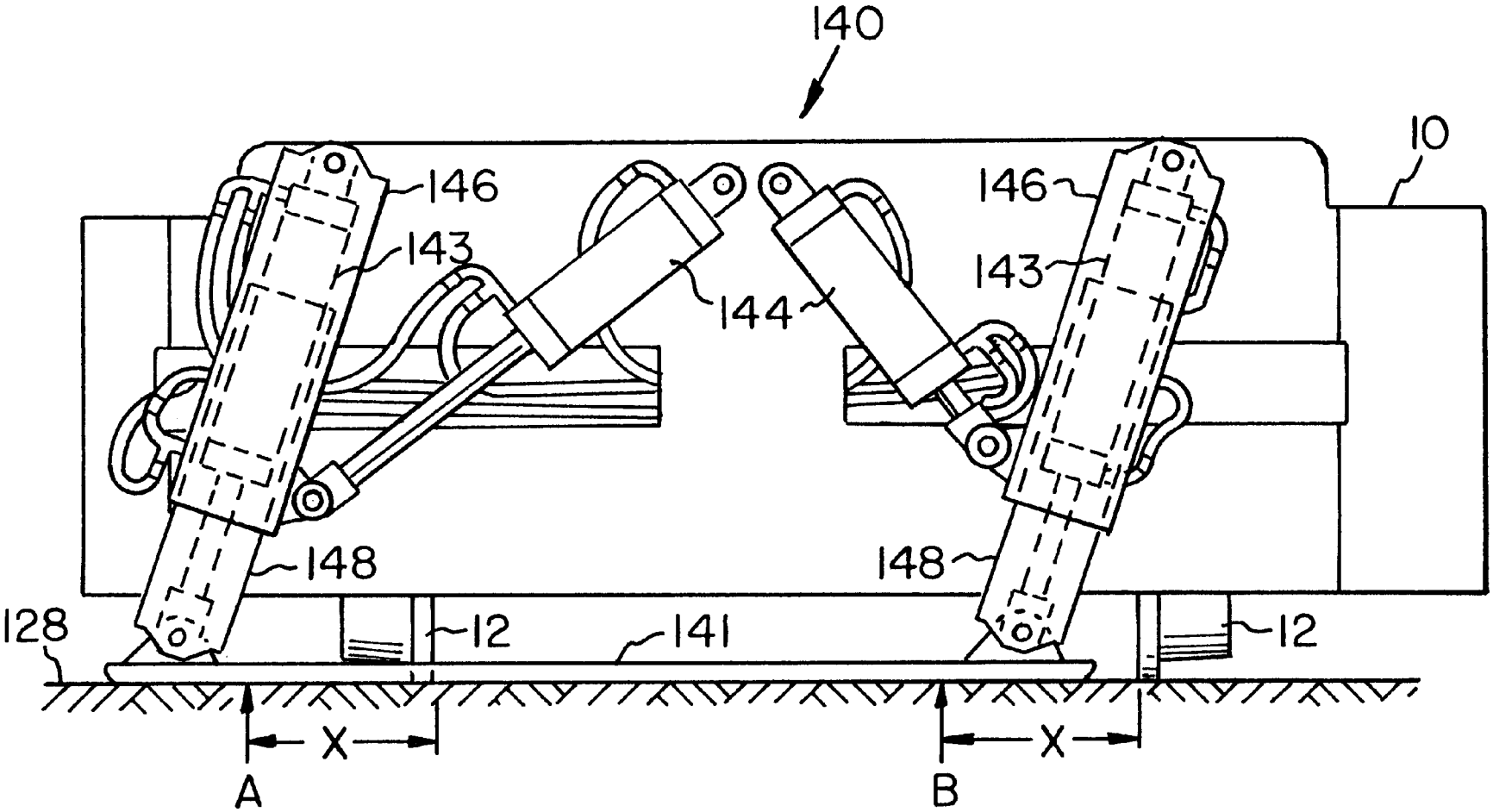
FIG. 23 is a front view of the rerailer shown in FIG. 20 during lowering of the rail car.
Figure 24:
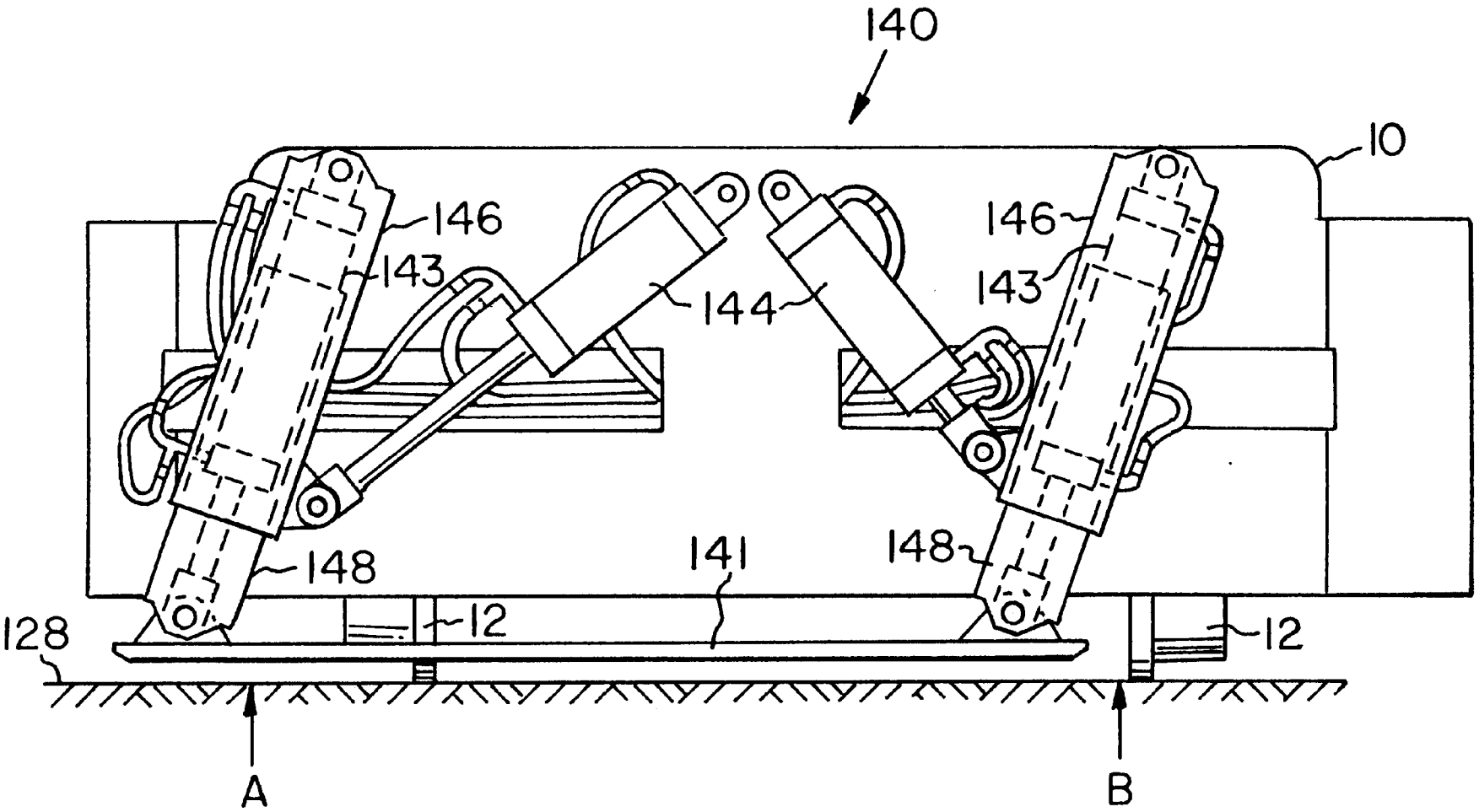
FIG. 24 is a front view of the rerailer shown in FIG. 20 during partial retraction of the foot.
Figure 25:
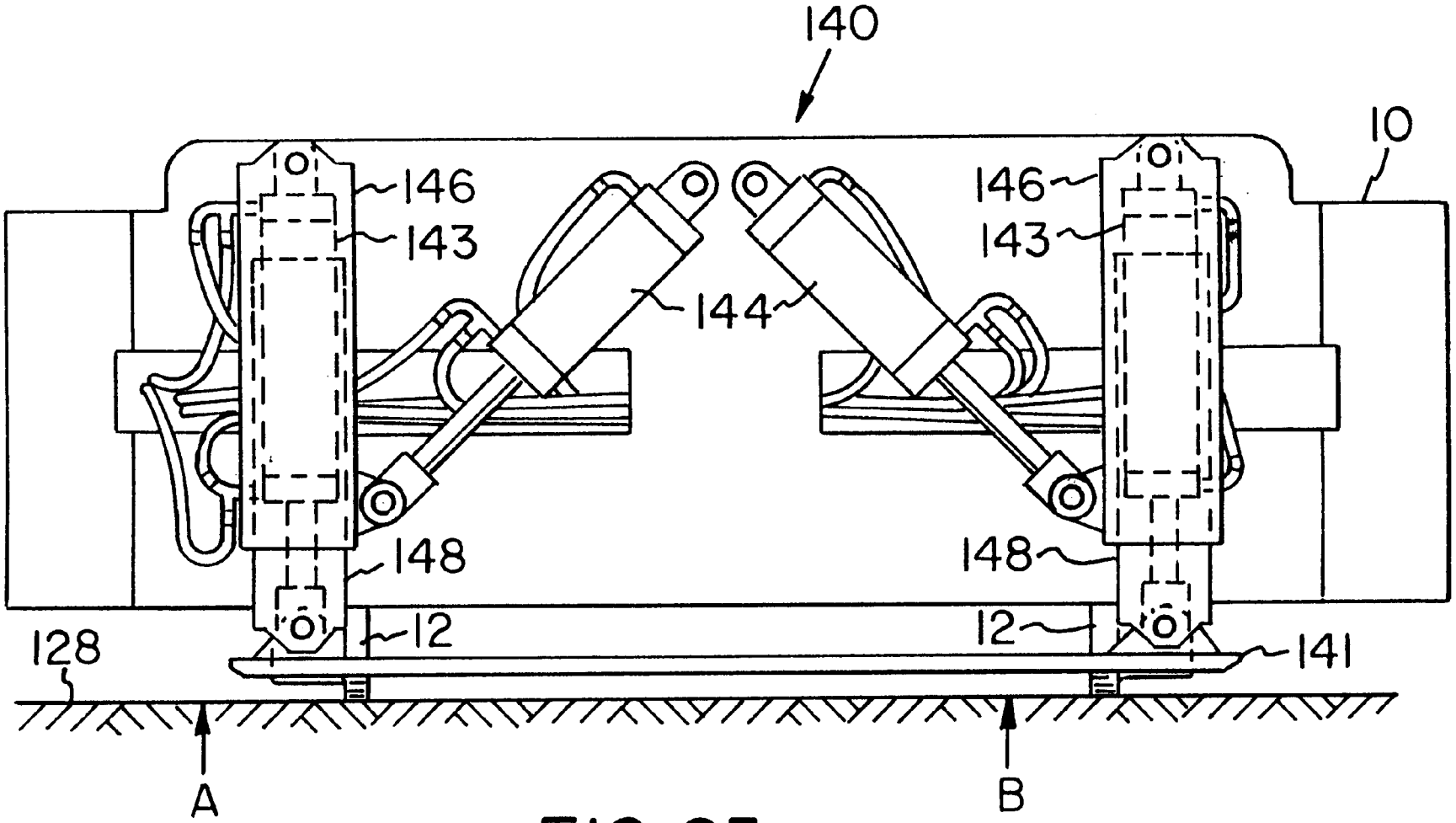
FIG. 25 is a front view of the rerailer shown in FIG. 20 during realignment of the foot.

FIGS. 20–25 show the operation of the rerailer 140 within the locomotive 10. FIG. 20 shows the rerailer 140 raised within the locomotive 10 that is resting on the ground 128. Reference points A and B in FIGS. 20–25 indicate the original position of the inside surface of wheels 12 of the locomotive 10 during the walking of the locomotive 10. FIG. 21 shows the foot 141 of the rerailer 140 in contact with the ground 128 and the locomotive 10 and its wheels 12 raised above the ground 128 when the vertical hydraulic cylinders 143 are actuated downward. FIG. 22 shows the locomotive 10 moving toward the right in relation to reference points A and B while the foot 141 remains stationary when left angled hydraulic cylinder 144 is extended and right angled hydraulic cylinder 144 is retracted. FIG. 23 shows the locomotive 10 lowered to the ground 128 at an angle, where the locomotive 10 is now a distance X from its original position. FIG. 24 shows the foot 141 of the rerailer 140 raised above the ground 128 but not fully retracted. Then the left angled hydraulic cylinder 144 is retracted and right angled hydraulic cylinder 144 is extended moving the foot 141 underneath the locomotive 10 as shown in FIG. 25. The operation shown in FIGS. 21–25 can be repeated until the locomotive 10 is rerailed. Once the locomotive 10 is rerailed, the rerailer 140 can be fully retracted into the locomotive 10 as shown in FIG. 20.

Figure 30A:
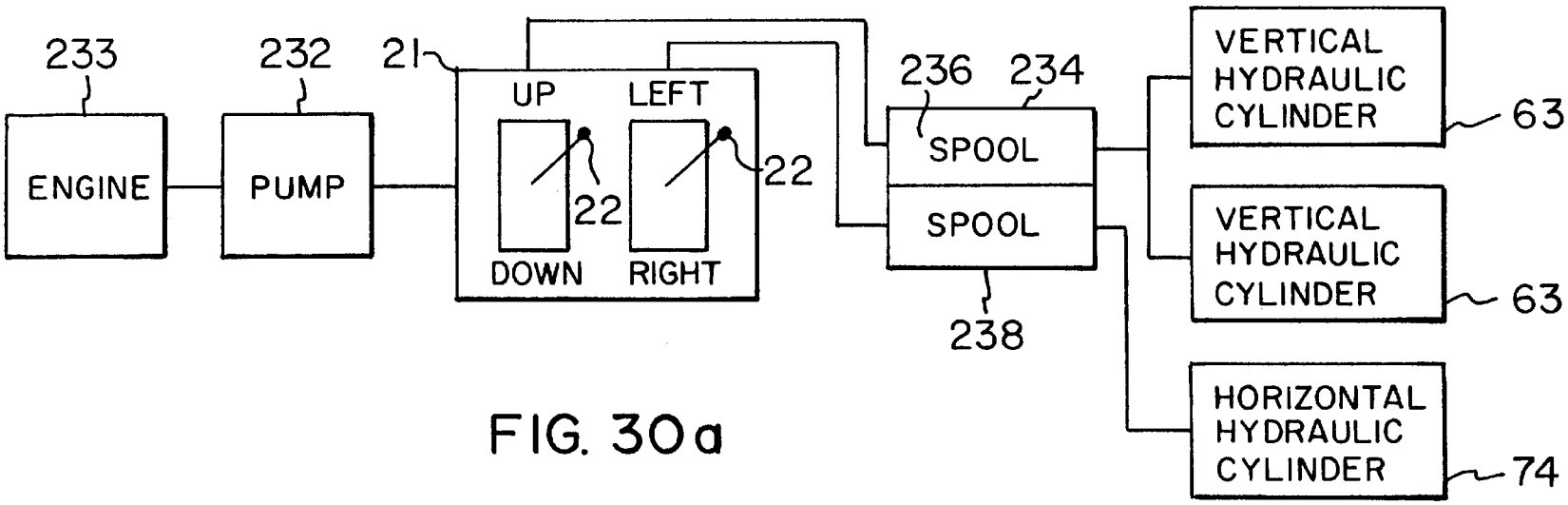
FIG. 30*a* is a schematic view of one valve arrangement used with the rerailer shown in FIG. 7.
Figure 30B:
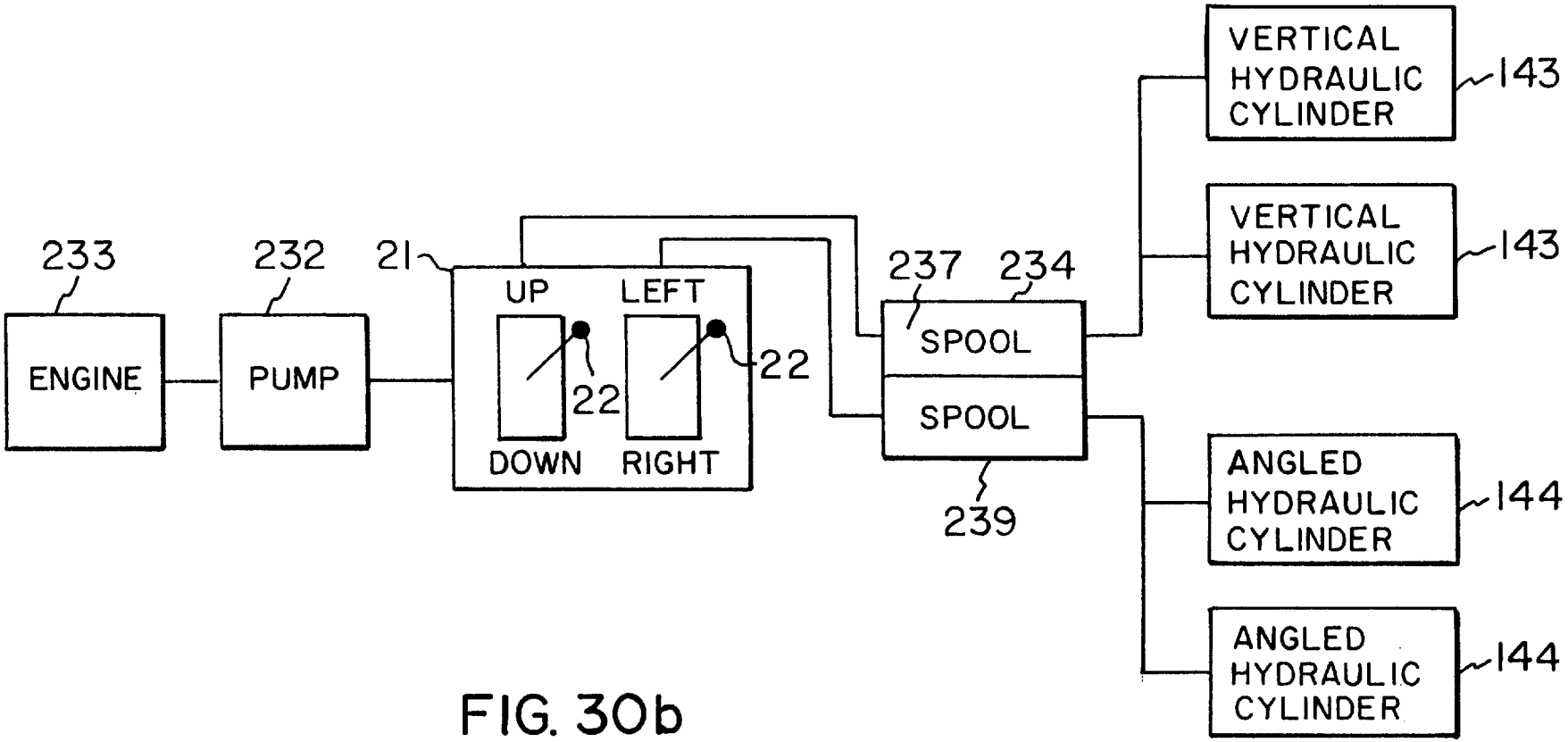
FIG. 30*b* is a schematic view of one valve arrangement used with the rerailer shown in FIG. 20.

The operation of the various hydraulic cylinders of the rerailers 60 and 140 discussed above can be driven by a gear pump 232 energized by an engine 233 or other power source as shown schematically in FIGS. 30*a* and 30*b*. The engine 233 can be a diesel engine, an electric motor or the like. All of the hydraulic cylinders of either rerailer 60 or 140 are controlled by a two spool directional control valve 234 usually mounted in the endsill of the locomotive 10. Each spool is a four way three position valve which is controlled by one of the valve control levers 22. As shown in FIG. 30*a* for rerailer 60, one spool 236 directs oil to the vertical hydraulic cylinders 63 and the other spool 238 directs oil to a horizontal hydraulic cylinder 74. As shown in FIG. 30*b* for rerailer 140, one spool 237 directs oil to the two vertical hydraulic cylinders 143 and the other spool 239 directs oil to the two angled hydraulic cylinders 144. Spool 239 is connected to the angled hydraulic cylinders 144 such that they act opposite to each other.

Figure 31:
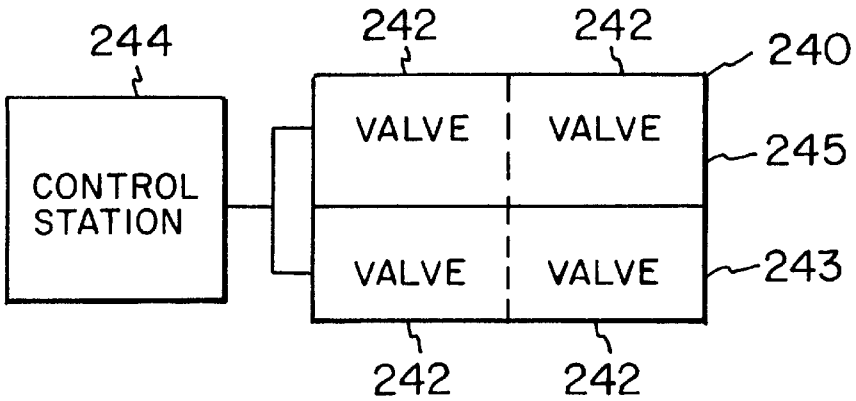
FIG. 31 is a schematic view of a second valve arrangement used with either embodiment of the rerailer of the present invention.

Electronic controls could be used as an alternative to the manual shifting of the hydraulic spool valves via the valve control levers 22, as shown schematically in FIG. 31. An electric valve bank 240 can be remotely mounted in the locomotive 10 having four valves 242, where a pair of valves 245 controls a front rerailer and the other pair of valves 243 controls a rear rerailer. Depending on which embodiment of the rerailer the valves are connected to, each pair of valves will operate as described above. A separate control station 244, instead of the levers 22, can be used to operate the electric valve bank 240.

While embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

We claim:

1. A rerailer apparatus for installation in a rail car comprising:

A) a foot;

B) at least two vertical lifting members connected to said foot and adapted to be connected to the rail car for lifting the rail car vertically;

C) a lateral movement mechanism which is adapted to allow the rail car to move laterally relative to said foot once said foot is lowered and the rail car is lifted, wherein said lateral movement mechanism includes i) a sliding platform acting as a connection between said vertical lifting members and said foot, said sliding platform slidably fixed to said foot to allow lateral movement between said sliding platform and said foot, and ii) at least one lateral movement device connected between said sliding platform and said foot to produce said lateral movement; and D) a control device to control the operation of said vertical lifting members and said lateral movement mechanism.

2. The rerailer of claim 1, wherein said foot includes a flange extending upward and said sliding platform includes two plates spaced apart to receive said flange, with said flange attached to one end of said lateral movement device and slidable between said plates.

3. The rerailer of claim 2, wherein said foot further includes a foot bearing assembly to provide uniform movement between said foot and said sliding platform and including a shaft and at least one foot bearing rotatably fixed to said shaft, and with said sliding platform further including a slot in at least one of said plates to receive and guide said foot bearing.

4. The rerailer of claim 3, wherein said sliding platform further includes a sliding platform bearing assembly to provide uniform movement between said foot and said sliding platform and including a shaft and at least one sliding platform bearing rotatably fixed to said shaft, with said sliding platform bearing movable along a top surface of said flange of said foot.

5. The rerailer of claim 4, wherein said sliding platform further includes a wear guide on each end of said sliding platform, with said wear guide including a permanent section fixed to said sliding platform, a replaceable section removably fixed to said permanent section and spacing shims placed between said permanent section and said replaceable section.

6. The rerailer apparatus of claim 1 further including a locking device preventing activation of said rerailer once said locking device is in a locking position.

7. A rail car having a self-contained rerailing system comprising:

A) a bumper on each end of said rail car;

B) a rerailer suspended in each bumper of said rail car, wherein said rerailer includes i) a foot, ii) at least two vertical lifting members connected between said rail car and said foot for lifting said rail car vertically, iii) a lateral movement member which allows said rail car to move laterally relative to said foot once said foot is lowered and said rail car is lifted, wherein said lateral movement member includes a) a sliding platform acting as a connection between said vertical lifting members and said foot, said sliding platform slidably fixed to said foot to allow lateral movement between said sliding platform and said foot, and b) at least one lateral movement device connected between said sliding platform and said foot to produce said lateral movement; and C) a control device mounted on each bumper to control an associated rerailer in the bumper where said control device is mounted, wherein said control device controls the operation of said vertical lifting members and said lateral movement member.

8. The rail car of claim 7, wherein said foot includes a flange extending upward and said sliding platform includes two plates spaced apart to receive said flange, with said flange attached to one end of said lateral movement device and slidable between said plates.

9. The rail car of claim 8, wherein said foot further includes a foot bearing assembly to provide uniform movement between said foot and said sliding platform and including a shaft and at least one foot bearing rotatably fixed to said shaft, and with said sliding platform further including a slot in at least one of said plates to receive and guide said foot bearing.

10. The rail car of claim 9, wherein said sliding platform further includes a sliding platform bearing assembly to provide uniform movement between said foot and said sliding platform and including a shaft and at least one sliding platform bearing rotatably fixed to said shaft, with said sliding platform bearing movable along a top surface of said flange of said foot.

11. The rail car of claim 7 further including a locking device onto each said bumper preventing activation of said rerailer once said locking device is in a locking position.

12. A rerailer apparatus for installation as part of a rail car comprising:

a foot;

a sliding platform, said sliding platform slidably fixed to said foot to allow lateral movement between said sliding platform and said foot;

at least two vertical hydraulic cylinders connected between the rail car and said sliding platform for lifting the rail car vertically;

at least one horizontal hydraulic cylinder connected between said sliding platform and said foot to produce said lateral movement; and a control device to control the operation of said vertical and horizontal cylinders.

13. The rerailer of claim 12, wherein said foot includes a flange extending upward and said sliding platform includes two plates spaced apart to receive said flange which extends beyond said plates, with said flange attached to one end of said horizontal hydraulic cylinder and slidable between said plates.

14. The rerailer of claim 13, wherein said foot further includes a foot bearing assembly to provide uniform movement between said foot and said sliding platform including a shaft and at least one foot bearing rotatably fixed to said shaft, and with said sliding platform further including a slot in at least one of said plates to receive and guide said foot bearing.

15. The rerailer of claim 14, wherein said sliding platform further includes at least one sliding platform bearing assembly to provide uniform movement between said foot and said sliding platform including a shaft and at least one sliding platform bearing rotatably fixed to said shaft, with said sliding platform bearing movable along a top surface of said flange of said foot.

16. The rerailer of claim 15, wherein said sliding platform further includes a wear guide on each end of said sliding platform, with said wear guide including a permanent section fixed to said sliding platform, a replaceable section removably fixed to said permanent section and spacing shims placed between said permanent section and said replaceable section.

17. The rerailer of claim 16, wherein said control device is a two-spool directional control valve where actuation of one spool controls said vertical hydraulic cylinders and actuation of a second spool controls said horizontal hydraulic cylinder.

* * * * *